United States Patent [19]

McLeod, Jr.

[11] Patent Number: 4,918,898

[45] Date of Patent: Apr. 24, 1990

[54] BUILDING PANEL

[76] Inventor: John D. McLeod, Jr., P.O. Box 885007, Leesburg, Fla. 32788-5007

[21] Appl. No.: 307,036

[22] Filed: Feb. 7, 1989

[51] Int. Cl.[5] ..... E04C 1/10

[52] U.S. Cl. ..... 52/588; 52/478; 52/537

[58] Field of Search ..... 52/478, 537, 588, 522, 52/542

[56] References Cited

U.S. PATENT DOCUMENTS

| | | | |
|---|---|---|---|
| 3,481,094 | 12/1969 | Taylor | 52/522 X |
| 3,555,758 | 1/1971 | Schroter | 52/478 X |
| 3,606,718 | 9/1971 | Curran | 52/542 |
| 3,733,767 | 5/1973 | Craik | 52/529 |
| 3,968,603 | 7/1976 | Merson | 52/86 |
| 4,109,437 | 8/1978 | Player et al. | 52/588 X |
| 4,155,206 | 5/1979 | Player | 52/200 |
| 4,192,117 | 3/1980 | Heirich | 52/478 |
| 4,223,503 | 9/1980 | Hague | 52/478 |
| 4,283,897 | 8/1981 | Thompson | 52/588 X |
| 4,369,609 | 1/1983 | Sheldon et al. | 52/478 |

FOREIGN PATENT DOCUMENTS

| | | | |
|---|---|---|---|
| 257361 | 9/1961 | Australia | 52/588 |
| 1509652 | 1/1960 | France | 52/588 |

*Primary Examiner*—Carl D. Friedman

*Attorney, Agent, or Firm*—Armstrong, Nikaido, Marmelstein, Kubovcik & Murray

[57] ABSTRACT

A building panel of the type having a planar central portion with a riser and locking member provided at each of two opposed edges of the central portion and which are adapted to connect in interlocking fashion with a locking member provided along an edge of an adjacent building panel of similar structure. Each locking member is provided in the form of a channel-shaped locking member connected to a substantially vertical riser by a portion of the panel extending at an angle relative to the riser. One locking member is connected to a riser by a portion extending inwardly relative to the panel and the other locking member is connected to a riser by a portion extending outwardly relative to the riser thereby providing for a concentric connection of each locking member with a locking member of an adjacent panel with the connection being concentric and substantially centered over the risers. A plurality of deep-set longitudinally extending ribs are provided in the central portion of the panel which together with the concentric, oversized locking members provides a rigid panel capable of extending over a substantial span length.

15 Claims, 2 Drawing Sheets

BUILDING PANEL

BACKGROUND OF THE INVENTION

The present invention is directed to a building panel and, more specifically, to an interlocking building panel which is adapted to connect with an adjacent panel of similar structure and which is particularly useful in overhead applications.

The use of interlocking building panels which are attached to a supporting frame work and assembled together to cover relatively large surface areas such as walls, roofs, awnings, and the like is well known in the building industry. Such panels are usually formed by rolling or press-braking flat aluminum or steel stock material. The particular alloys and thickness of the stock material are selected taking into consideration structural design features of the building panel and the application for which the building panel is intended. The building panels are usually formed with a riser or a flange at one edge or at two oppositely disposed edges of the building panel which serve to connect or lock the building panel to an adjacent building panel and also usually serve to secure the building panel to the supporting frame work. The main or central portion of the panel extending from the riser(s) at one or both ends of the panel together with the central portion of adjacent panels provide a surface facing over the area of the supporting frame work and it is this surface facing that remains visible after assembly and construction are completed.

Although the building panels are not usually utilized as load bearing structural components, the panels must have sufficient strength and rigidity to be self-supporting and resistant to normal contact over the central portion thereof. Various factors must be taken into consideration in developing a design and selecting materials for panels which may be used in different applications. For example, one might consider the design characteristics and selection of material to provide strength and rigidity in a building panel to provide a wall facing more important than in a building panel to provide a ceiling or roof facing since the wall facing may be subject to greater or more frequent impact than a ceiling or roofing facing which is remote from pedestrian and vehicle traffic. On the other hand, the central portion of a building panel used as a ceiling facing or roofing must be sufficiently rigid and have adequate strength to avoid sagging under its own weight and any additional load which may be applied by insulation, fire retardant and/or roofing coatings. The cost of a particular building panel system is of course a significant consideration in determining basic panel design and selecting the material to be used in forming the panel. To a certain extent the cost of the building system materials and assembly can be reduced through the use of larger rather than smaller building panels. However, as the size of a building panel increases it becomes necessary to use either a stronger alloy, thicker stock material or incorporate design features to enhance the strength and rigidity of the building panel. Building panels which are to be utilized as surface facing components in ceiling and/or roofing applications, particularly the central portion of such building panels, must be capable of retaining their shape and form over the length or width of whatever span of the supporting frame work the central portion of the building panel is intended to cover.

Reinforcing ribs or beads formed to extend longitudinally along a central portion of a building panel; such as the ribs or beads shown in U.S. Pat. Nos. 3,555,758, 3,733,767, 4,109,437 and 4,155,206 have been proposed to increase the rigidity of the central portion of a building panel. Building panels having risers along each of two opposed edges of the panel with interlocking connecting members at the terminal ends of the risers have also been disclosed for various purposes in those patents as well as U.S. Pat. Nos. 3,481,094, 3,968,603, 4,192,117, 4,223,503 and 4,369,609. These patents are representative of the many varied efforts to accommodate specific as well as more generalized problems in the design and use of building panels in the building industry and of course reflect that the design and use of interlocking building panels has become highly specialized.

The present invention provides an improved building panel design of the type which includes a riser at each of two opposed edges of a central portion of the panel with each riser providing a structure for interlocking the building panel to an adjacent panel of similar structure. The structure of the building panel of the present invention, particularly the structure providing the risers and the interlocking connecting means at each of the opposed edges of the building panel is unique and provides a building panel structure which is capable of being installed to provide a ceiling facing over a greater span than heretofore building panels utilized in such applications.

SUMMARY OF THE INVENTION

The present invention provides a building panel adapted to connect or interlock with an adjacent panel of similar structure having a substantially planar central portion with two opposed edges. A first riser at one of the edges extends substantially normal to the central portion and is connected to the central portion by a first portion extending outwardly at an angle of 45° to the central portion. A first channel-shaped locking member is connected to the first riser by a second portion extending inwardly relative to the central portion at an angle of 45° relative to the first riser. The first channel-shaped locking member is substantially centered relative to the first riser and defines a longitudinally extending opening at least partly bounded by the second portion. A second riser at the other edge of the panel extends substantially normal to the central portion and is connected to the central portion by a third portion extending outwardly at an angle of 45° relative to the central portion. A second channel-shaped locking member is connected to the second riser by a fourth portion extending outwardly relative to the central portion at an angle of 45° relative to the second riser. The second channel-shaped locking member is substantially centered relative to the second riser and is dimensioned to be snugly received internally of a longitudinally extending opening of a first channel-shaped locking member of an adjacent panel with the second riser and the fourth portion of the panel abutting a first riser and a second portion of the adjacent panel.

In the preferred embodiment a generally channel-shaped female locking member is connected to the first riser and a generally channel-shaped male locking member is connected to the second riser, the female locking member is substantially centered relative to the first riser and defines a longitudinally extending opening bounded at one side by the second portion and at the other side by a depending wall. Thus, when two building panels of the present invention are assembled, the male locking member of one panel, for example a second panel, is positioned internally of the female locking member of the other panel, for example a first panel, with a depending portion of the male locking member abutting the depending wall partly defining the opening in the female locking member and biasing the second riser and the fourth portion of the second panel into abutting surface contact with the first riser and the second portion of the first panel.

In the preferred embodiment the channel-shaped female locking member also includes a planar portion substantially parallel to the planar central portion of the building panel and a depending leg substantially normal to the planar portion and the male locking member includes a surface adapted to abut the planar portion of a female locking member of an adjacent building. An edge portion of the depending wall of the female locking member is turned inwardly to provide a seating surface for an edge of a depending portion of the male locking member and the edge of the inwardly turned edge portion of the female locking member is turned outward relative to the longitudinally extending opening to facilitate insertion of the male locking member.

In the preferred embodiment the planar portion of the female locking member is also provided with a longitudinally extending indentation or groove to identify a linear pattern of proposed fastener locations and an outer surface of the male locking member is provided with a recess to provide a space between the interfacing surfaces of the male and female locking members and preferably in a location directly opposite the pattern of proposed fastener locations in the planar portion of a female locking member of an adjacent panel.

In the preferred embodiment the central portion of the building panel is comprised of a plurality of longitudinally extending planar sections joined by a plurality of deep-set longitudinally extending ribs.

The present invention thus provides a building panel having a riser and channel-shaped locking member at each of two opposed edges of the panel with each of the channel-shaped locking members being substantially centered over its respective riser and being larger than conventional locking members which in combination with other structural features such as the portions of the panel connecting each locking member to its respective riser and the risers to the panel as well as the deep-set longitudinally extending ribs provide a panel structure which is capable of spanning a greater width especially when suspended from an overhead frame work to provide a ceiling or other overhead cover facing surface.

The present invention and the advantages provided thereby will be more fully understood with reference to the following detailed description of a preferred embodiment and claims taken in conjunction with the accompanying drawings.

DESCRIPTION OF THE PREFERRED EMBODIMENT

Figure 1:
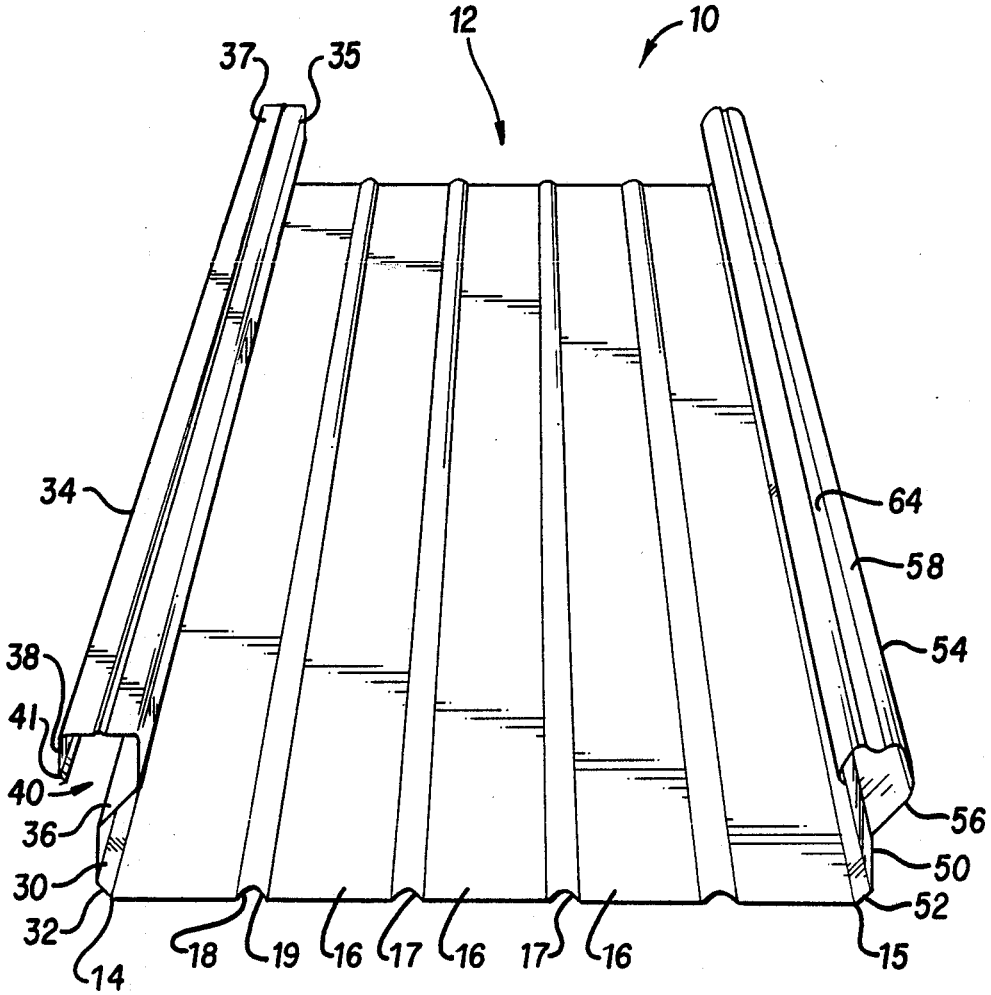
FIG. 1 is a perspective view of a building panel of the present invention.
Figure 2:
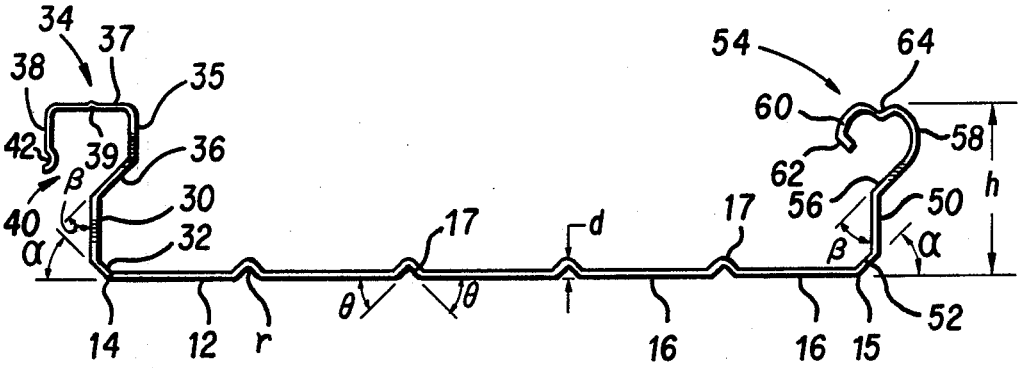
FIG. 2 is an end view, slightly enlarged, of the building panel of FIG. 1.

With reference to the drawings, wherein like reference numerals designate the same or like parts throughout, there is shown a building panel 10 having a central planar portion 12 with two opposed edges 14 and 15. The central portion 12 of the building panel is comprised of a plurality of longitudinally extending planar sections 16 joined by a plurality of longitudinally extending "deep-set" ribs 17. The depth d of the ribs 17 as shown by FIG. 2 is at least ¼" which constitutes a minimum depth of 1/10 of the overall height h of the panel which is 2½". The side walls 18 and 19 of the longitudinally extending ribs 17 are formed at an angle Θ of 45° relative to the planar central portion 12 of the building panel 10.

A riser and locking member structure is provided at each of the proposed edges 14 and 15 of the planar central portion 12 of the building panel. A first riser 30 is provided at the edge 14 and a second riser 50 is provided at the edge 15.

The first riser 30 extends substantially normal to the central portion 12 and is connected to the central portion 12 by a first portion 32 which extends outwardly at an angle $\alpha$ of 45° relative to the central portion 12. A first locking member 34 is connected to the first riser 30 by a second portion 36 which extends inwardly relative to the central portion 12 at an angle $\beta$ of 45° relative to the first riser 30. The first locking member 34 is provided as a channel-shaped, female locking member of generally rectangular cross-section defined by planar wall sections 35 and 37 and a depending wall 38. The channel-shaped female locking member 34 provides a longitudinally extending opening 40 bounded at one side by the depending wall 38 and at the other side by the second portion 36. An indentation 39 is formed along the center of the internal surface of the wall section 39. The indentation 37 provides a guide indicating the preferred location for a linear pattern of fasteners.

The lower edge portion 41 of the depending wall 38 is rolled during forming to provide a first portion 42 which is turned inwardly relative to the locking member 34 and a portion 44 which is turned outwardly relative to the longitudinally extending opening 40.

The riser 50 extends substantially normal to the central portion 12 and is connected to the central portion by a third portion 52 which extends outwardly at an angle $\alpha$ of 45° relative to the central portion 12. A second channel-shaped locking member 54 is connected to the riser 50 by a fourth portion 56 which extends outwardly relative to the planar central portion 12 at an angle $\beta$ of 45° relative to the second riser 50. The second locking member 54 provides a male locking member of generally C-shaped cross-section having a curved outer surface 58 terminating in a downward directed or depending portion 60. The edge 62 of the depending portion 60 is turned inward. A recess 64 is formed to extend longitudinally along an upper or top portion of the curved outer surface 58.

Figure 3:
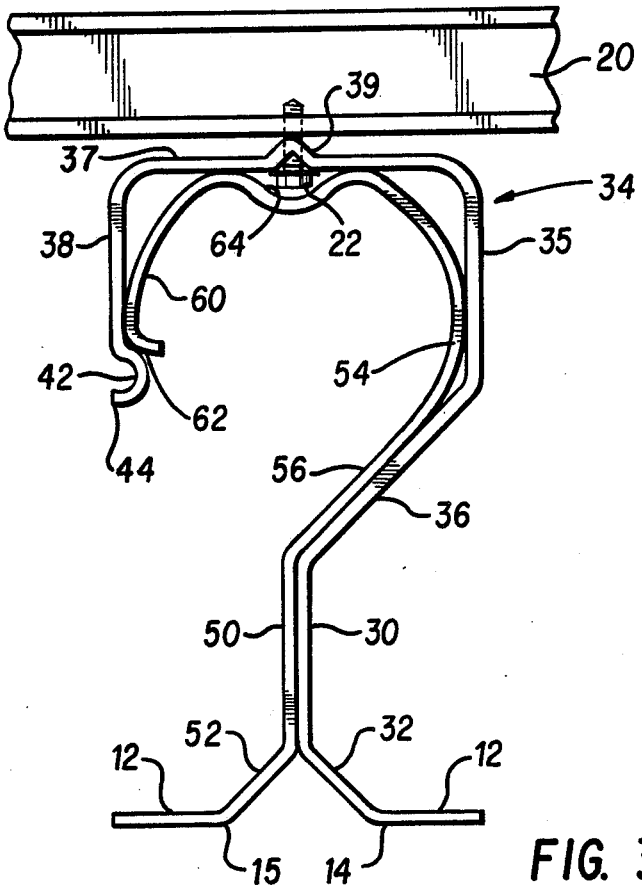
FIG. 3 is an end view, partly broken away, showing an assembly of two of the building panels of FIG. 1.

An assembly of two building panels of the present invention in a suspended mode to provide a ceiling type facing or cover for a ceiling, awning or marquis will be described with reference to FIG. 3. In FIG. 3 a female locking member 34 connected to a riser 30 of a first building panel is secured to a beam or purling by means of a fastener 22 provided through the wall section 37 at the indentation 39. Although a single self-threading, screw type fastener is shown in FIG. 3 it is to be understood that a plurality of such fasteners are provided spaced along the length of the indentation 39 to support other portions of the first panel from additional support members provided behind the support member 20 as viewed in FIG. 3. Rivets and other fastening members commonly used in the building trade may also be used in place of a self-tapping screw fastener. Once the first panel is secured to the supporting frame work, a second panel is moved into position with the male locking member 54 adjacent the longitudinally extending opening 40 provided by the female locking member 34 and inserted through the opening 40. The male locking member 54 may be disposed at an angle relative to the longitudinally extending opening 40 and rolled into the interior of the female locking member 34 or it may be forced directly through the opening 40 with the depending wall 38 and the depending portion 60 flexing outwardly and inwardly respectively until the male locking member 54 is seated internally of the female locking member 34. The outwardly turned edge 44 of the lower edge portion 41 of the depending wall 38 of the female locking member provides for smooth movement of the curved outer surface 58 of the male locking member through the longitudinally extending opening 40 and thus facilitates insertion of the male locking member 54 internally of the female locking member 34. As shown by FIG. 3 the male locking member 54 is dimensioned to be snugly received internally of the female locking member 34 with the turned in edge 62 of the male locking member 54 seated against the inwardly turned edge portion 42 of the female locking member. The curved outer surface 58 of the male locking member abuts the internal surfaces of the wall sections 35 and 37 of the locking member 34 and the riser 50 and fourth portion 56 of the second panel are biased into abutting surface contact with the riser 30 and second portion 36 of the first panel. The oversized locking members 34 and 54 are thus connected and substantially centered over the risers 30 and 50 with the abutment of the curved outer surface 58 of the male locking member with the planar inner surface of the wall section 37 of the female locking member providing resistance against upward pressure on the second panel and the abutting contact between the second portion 36 and the fourth portion 56 resisting upward movement of the first panel and downward movement of the second panel.

The second portion 36 disposed at a 45° angle relative to the riser 30 and extending inwardly relative to the building panel and connecting the female locking member 34 to the riser 30 together with the fourth portion 56 disposed at a 45° angle relative to the riser 50 and extending outwardly relative to the building panel and connecting the male locking member to the riser 50 are significant features of the structure of the building panel of the present invention since they resist vertical movement of an assembly of adjacent panels and add strength to an assembly of adjacent panels by providing for a concentric connected assembly of the male and female locking members 34 and 54 centered above the risers 30 and 50. The deep-set longitudinally extending reinforcing ribs 17 also contribute to the strength or rigidity of the building panel of the present invention and together with the concentric and substantially centered oversized locking members 34 and 54 permit building panels of the present invention to be installed in a suspended mode as shown by FIG. 3 with each panel spanning a distance of 12" between the risers 30 and 50. Conventional flat bottomed building panels having the same weight as the building panel of the present invention have been tested and found to be incapable of spanning the same distance as the building panel of the present invention. The improved capability of the building panel of the present invention is believed to result from the oversized locking members provided at each edge of the panel as well as the structural features of the portions connecting the locking members to the risers and the planar central portion of the panel.

The first and third portions 32 and 52 connecting the risers 30 and 50 respectively to the central portion of a building panel 12 are each disposed outwardly relative to the panel at an angle of 45°. The first portion 32 and the third portion 52 are respectively spaced from the side walls 18 and 19 of the adjacent longitudinally extending rib 17 to provide the appearance of another equally spaced rib 17 at the interface between the risers 30 and 50 as shown by FIG. 3. Thus the juncture of the first and third portions 32 and 52 where the first and second panels are assembled together provides a continuation of the appearance of a plurality of equally spaced longitudinally extending reinforcing ribs over the entire area covered by an assembly of building panels of the present invention.

Although a single embodiment of the invention has been disclosed, the present invention is not to be construed as limited to the particular form disclosed herein since the foregoing description is to be regarded as illustrative rather than restrictive and it should be understood that modifications and variations in the details of construction may be made without departing from the spirit and the scope of the invention as defined by the claims appended hereto.

What is claimed is:

1. A building panel adapted to connect with an adjacent panel of similar structure comprising:

a substantially planar central portion with two opposed edges, a first riser at one of said edges extending substantially normal to said central portion and connected to said central portion by a first portion extending outwardly at an angle relative to said central portion, a first channel-shaped locking member connected to said first riser by a second portion extending inwardly relative to said central portion at an angle of 45° relative to said first riser, said first channel-shaped locking member being substantially centered relative to said first riser and defining a longitudinally extending opening at least partly bounded by said second portion, a second riser at the other said edge extending substantially normal to said central portion and connected to said central portion by a third portion extending outwardly at an angle relative to said central portion, a second channel-shaped locking member connected to said second riser by a fourth portion extending outwardly relative to said central portion at an angle of 45° relative to said second riser, said second channel-shaped locking member being substantially centered relative to said second riser and dimensioned to be snugly received internally of a longitudinally extending opening of a first channel-shaped locking member of an adjacent panel with said second riser and said fourth portion of said panel abutting a first riser and a second portion of said adjacent panel.

2. A building panel as defined by claim 1, wherein said first channel-shaped locking member includes a planar portion substantially parallel to said planar central portion of said building panel and a depending leg substantially normal to said planar portion of said first channel-shaped locking member and terminating in an out turned edge.

3. A building panel as defined by claim 1, wherein said first channel-shaped locking member includes a planar portion substantially parallel to said planar central portion of said building panel and means extending longitudinally along said planar portion of said first channel- shaped locking member and identifying a pattern of proposed fastener locations.

4. A building panel as defined by claim 3, wherein said means identifying a pattern of proposed fastener locations is an indentation extending longitudinally along the center of said planar portion of said first channel-shaped locking member.

5. A building panel as defined by claim 1, wherein said central portion of said building panel is comprised of a plurality of longitudinally extending planar sections joined by a plurality of longitudinally extending ribs.

6. The building panel defined by claim 5, wherein said longitudinally extending planar sections are joined by deep-set ribs having side walls disposed at a 45° angle relative to said longitudinally extending planar sections.

7. A building panel as defined by claim 1 and further including a recess extending longitudinally along an outer surface of said second channel-shaped locking member.

8. A building panel as defined by claim 7, wherein said recess is located along said outer surface of said second channel-shaped locking member and opposes a fastener positioning line extending longitudinally along a first channel-shaped locking member of an adjacent panel.

9. An interlocking panel assembly comprising, in combination:

a first panel having a substantially planar central portion and two opposed edges, a first riser at one of said opposed edges extending substantially normal to the central portion of said first panel and connected to said central portion by a first portion extending outwardly at an angle of 45° relative to said central portion, a generally channel-shaped female locking member connected to said first riser by a second portion extending inwardly relative to said central portion at an angle of 45° relative to said first riser, said channel-shaped female locking member being substantially centered relative to said first riser and defining a longitudinally extending opening bounded at one side by said second portion and at the other side by a depending wall, and a second panel having two opposed edges and a planar central portion which is substantially co-planar with said planar central portion of said first panel, a second riser at one of said opposed edges of said second panel, said second riser extending substantially normal to the central portion of said second panel and connected to said central portion of said second panel by a third portion extending outwardly at an angle of 45° relative to said central portion of said second panel, a generally channel-shaped male locking member connected to said second riser by a fourth portion extending outwardly relative to said central portion of said second panel at an angle of 45 ° relative to said second riser, said channel-shaped male locking member being positioned internally of and interlocked with said channel-shaped female locking member of said first panel with a depending portion of said channel-shaped male locking member abutting said depending wall defining said other side of said longitudinally extending opening and biasing said second riser and said fourth portion of said second panel into abutting surface contact with said first riser and said second portion of said first panel and said female and male locking members are substantially centered over said first and second risers.

10. An interlocking panel assembly as defined by claim 9, wherein an edge portion of said depending wall of said channel-shaped female locking member is turned inwardly relative to said longitudinally extending opening and an edge of said depending portion of said channel-shaped male locking member is seated against said inwardly turned edge portion of said channel-shaped female locking member.

11. An interlocking panel assembly as defined by claim 10, wherein the edge of said inwardly turned edge portion of said channel-shaped female locking member is turned outward relative to said longitudinally extending opening to facilitate insertion of said channel-shaped male locking member internally of said channel-shaped female locking member.

12. An interlocking panel assembly as defined by claim 10, wherein said edge of said depending portion of said channel-shaped male locking member is turned inwardly and abuts against said inwardly turned edge portion of said depending wall of said channel-shaped female locking member to seat said male locking member internally of said female locking member.

13. An interlocking panel assembly as defined by claim 9, wherein said channel shaped female locking member of said first panel further includes a planar portion which is substantially parallel to said central planar portion of said first panel and located between said second portion and said depending wall of said channel-shaped female locking member, said channel-shaped male locking member includes a surface abutting said planar portion of said channel-shaped female locking member and a recess formed in at least one of said planar portion of said female locking member and said surface abutting said planar portion to provide a space between said planar portion and said abutting surface with said space extending longitudinally along the length of said channel-shaped locking members.

14. An interlocking panel assembly as defined by claim 13 wherein a recess is formed in said surface of said male locking member abutting said planar portion of said female locking member.

15. An interlocking panel assembly as defined by claim 14 further including an indentation formed in said planar portion of said female locking member and said indentation extends longitudinally along the length of said female locking member and is located opposite to said recess formed in said abutting surface.

* * * * *